US005421429A

United States Patent [19]

Evans

[11] Patent Number: 5,421,429

[45] Date of Patent: Jun. 6, 1995

[54] LADDER WITH SAFETY FEET

[76] Inventor: John Evans, Rte. 1, Box 152, Fort Cobb, Okla. 73038

[21] Appl. No.: 237,994

[22] Filed: May 4, 1994

[51] Int. Cl.[6] ..... E06C 7/44

[52] U.S. Cl. ..... 182/111; 182/201

[58] Field of Search ..... 182/107–111, 182/172, 200, 201

[56] References Cited

U.S. PATENT DOCUMENTS 2,008,582 7/1935 Fredriksen ..... 182/108 X
3,012,628 12/1961 Zumbaum ..... 182/172
3,025,926 3/1962 Vives ..... 182/111 X

*Primary Examiner*—Alvin C. Chin-Shue
*Attorney, Agent, or Firm*—Young & Thompson

[57] ABSTRACT

A ladder having legs having lower ends, has a safety foot pivotally connected to each lower end. Each safety foot has a hinge having two plates one of which is secured to the ladder foot and the other of which is secured to the lower end of the ladder leg. One of the hinge plates supports a stop surface that contacts a stop surface supported by the other hinge plate when the foot is at right angles to the ladder leg. The foot is releasably retained in a position parallel to the ladder leg. The releasible retainer is hook and eye fabric one element of which is connected to the lower end of the ladder leg and the other element of which is connected to the foot. The hinge plate is integral with a member that extends along the lower end of the leg, one element of the hook and eye fabric being fixedly secured at one end between this member and the leg and being free at another end thereof. One of the stop surfaces is provided by a member that is L-shaped to surround the hinge. This L-shaped member is disposed below the lower end of the leg. The ladder can be a stepladder, in which case a ground engaging edge of the foot is inclined at an acute angle to the axis of the hinge.

5 Claims, 1 Drawing Sheet

FIG. 1
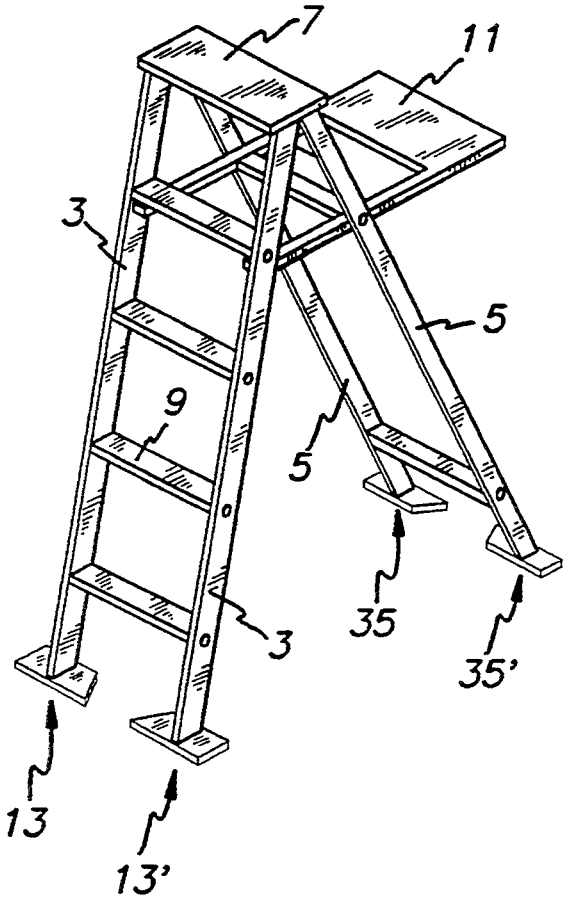
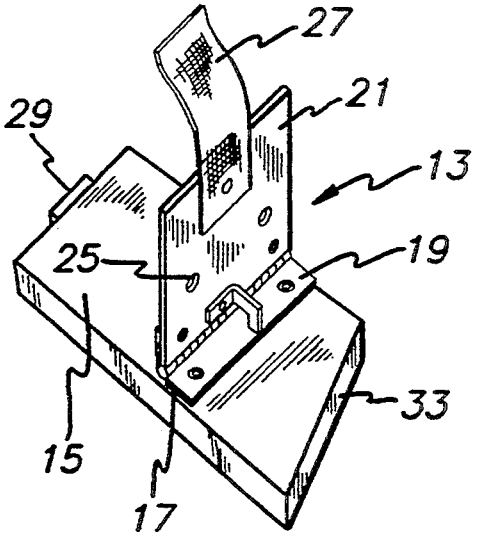
FIG. 2
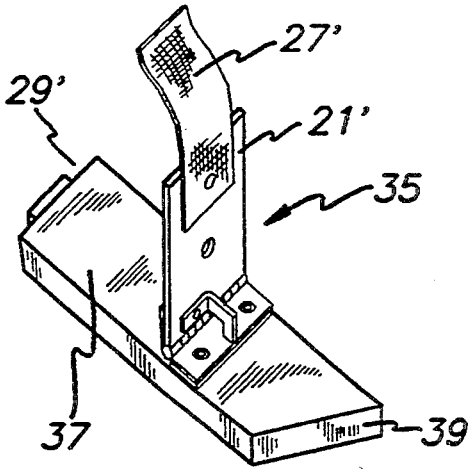
FIG. 5
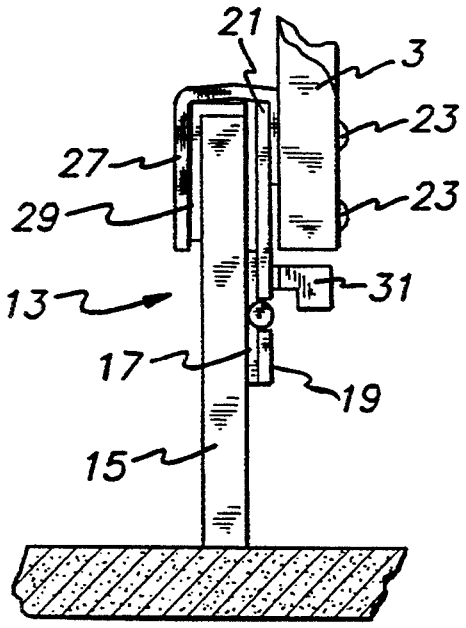
FIG. 3
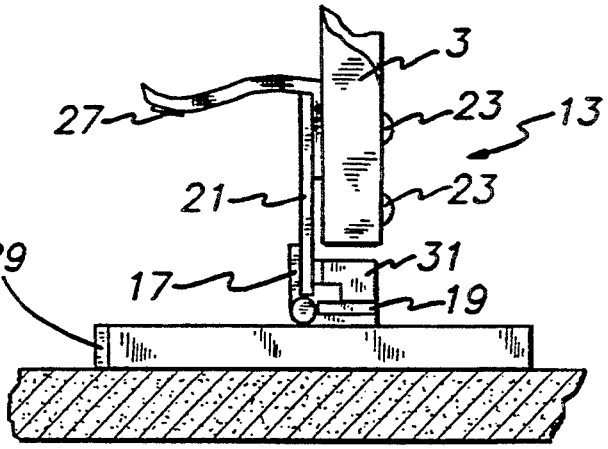
FIG. 4

LADDER WITH SAFETY FEET

BACKGROUND OF THE INVENTION

1. Field of the Invention

The present invention relates to ladders with safety feet designed to prevent the feet of the ladder from digging into the ground, thereby to maintain the ladder stable and safe in use when supporting the weight of a user.

2. The known Prior Art

It is known to provide ladders with broadened feet to prevent their digging into the ground. It is also known to make provision for collapsing these feet in general prolongation of the ladder, when not in use.

Typical structures for doing this are disclosed in U.S. Pat. Nos. 1,879,017, 1,909,620, 3,012,628, 3,025,926, and 3,456.757.

However, the devices disclosed in these earlier patents are relatively complicated and expensive and not always reliable.

OBJECTS OF THE INVENTION

It is accordingly an object of the invention to provide a ladder with safety attachments in the form of feet that can be swung from an inoperative or collapsed position to an operative or extended position and which, in the extended position, will safely and reliably support the feet of the ladder against sinking into the ground when the ladder supports the weight of a user.

Another object of the present invention is to provide such a ladder with deployable feet, which will be inexpensive to manufacture.

Finally, it is an object of the present invention to provide such a ladder with extensible feet, that will be easy to manipulate and rugged and durable in use.

SUMMARY OF THE INVENTION

The above and other object of the invention are achieved, by providing a ladder having foldable feet which, when folded against the ladder legs extend in prolongation of the ladder legs and are held in that folded position by a simple clasp.

When the clasp is released, the foot can swing 90° relative to the ladder leg to a predetermined position which is fixed by a positive stop comprised by relatively swingable interengaging parts. A hinge is provided between the ladder leg and the foldable foot, and relatively swingable parts of the hinge support the interengagable stops. The ladder can be a stepladder, in which case the foldable feet have ground engaging edges that are inclined, in the case of the front legs of the stepladder, at an angle opposite the angle at which are inclined the ground engaging edges of the feet of the rear legs of the stepladder.

Other objects, features and advantages of the present invention will become apparent from a consideration of the following description, taken in connection with the accompanying drawing, in which:

FIG. 1 is a perspective view of a ladder, specifically a stepladder, having a safety feature according to the present invention;

FIG. 2 is an enlarged perspective view of a safety foot for a front leg of the ladder of FIG. 1;

FIG. 3 is a fragmentary front elevational view of the foot of FIG. 2 in collapsed position in which a lower edge of the foot serves as an extension of the front stepladder leg;

FIG. 4 is a view similar to FIG. 3 but showing the ladder foot in its extended position; and FIG. 5 is a view similar to FIG. 2 but showing a foot of a rear leg of the stepladder of FIG. 1.

DETAILED DESCRIPTION OF THE INVENTION

Referring now to the drawings in greater detail, and first to FIG. 1 thereof, there is shown a ladder having a safety foot according to the present invention, indicated generally at 1, and comprising in this instance a stepladder. Stepladder 1 has front legs 3, rear legs 5, a top step 7 and lower steps 9. A folding shelf 11 is provided for supporting a paint bucket or the like. As is conventional, front and rear legs 3 and 5 are collapsible toward each other for storage, to reduce the volume occupied by the stepladder.

At the lower end of each front leg 3 is a foot 13, 13', of which one is shown in FIG. 2 with only a fragment of the leg 3 to which it is attached. As is there shown, the foot 13 comprises a slab 15, of wood of the like, to which is fixedly secured one of the plates of a hinge 17. To that same hinge plate is secured a plate 19 of metal, and to the other hinge plate is secured a plate 21 of metal which is substantially longer in a vertical direction than the plate 19. The lower end of the corresponding front leg 3 of stepladder 1 is secured to plate 21 by fasteners 23 passing through holes 25 in plate 21.

A strap of hook and eye fabric 27 is secured to plate 21 between plate 21 and the lower end of front leg 3; and a piece 29 of mating hook and eye fabric is fixedly secured to an end edge and the underside of slab 15. Strap 27 is fixedly secured only at one end and is free and flexible for the rest of its length.

Fixedly secured to plate 21 below the lower end of leg 3 is a metal foot 31 which in the illustrated embodiment has a base fixedly secured to plate 21 and to portion projecting at right angles to plate 21 of L-shaped configuration so as to clear the hinge upon swinging.

The operation of the device as thus far described is as follows:

When the ladder is to be supported on a firm support such as a wooden floor or concrete slab, where there is no possibility for the legs of the ladder to sink into a soft substance, the parts are in the FIG. 3 position. In this position, the hinge 17 is fully extended and the slab 15 is approximately parallel to front leg 3 of the ladder and extends downwardly below the lower end of the front leg of the ladder. The parts are releasably retained in this position by the interengagement of strap 27 and piece 29. In this position, the weight on the ladder is transferred from leg 3 to plate 21 to hinge 17 and then to slab 15, and thus lower edge 33 supports the weight of leg 3.

Notice particularly in FIG. 2 that the lower edge 33 is not parallel to hinge 17. Instead, it is cut off on the bias, at the same angle as the lower end of front leg 3 of the stepladder, so that when the stepladder is open in the FIG. 1 position and the feet 13, 13' are not deployed, lower edge 33 will rest flat against a firm supporting surface along its entire length, that is, from the front vertical edge to the rear vertical edge of slab 15.

With the hook and eye fabric members 27 and 29 disengaged, the slab 15 can be swung to the FIG. 3 position, after which the strap 27 is applied to piece 29 and that position is retained.

But when the ladder is to be erected on a soft support such as soft soil, sand of the like, then strap 27 is released and slab 15 is swung down to the FIG. 4 position, in which slab 15 is at about a 90° angle to front leg 3 (a portion of piece 29 of the hook and eye fabric is pressed into the soil in FIG. 4 and so does not appear in the figure).

In the FIG. 4 or extended position of foot 13, swinging movement of slab 15 relative to leg 3 in one direction of hinge 17 is prevented by positive interengagement of the plate 19 and foot 31, these members at this time serving as stops to limit clockwise swinging of leg 3 relative to slab 15.

Counterclockwise swinging of leg 3 relative to slab 15, however, is not prevented by the FIG. 4 structure. Instead, this counterclockwise swinging of leg 3 relative to slab 15 is prevented by the foot 13' on the other front leg 3 of the ladder 1, which, for this purpose, is the mirror image of FIG. 4 when viewed in the same direction as FIG. 4.

On the rear legs 5 of the ladder, a safety foot 35 is provided, as seen in FIG. 5. Foot 35 is generally similar to foot 13 except that the corresponding slab 37 is narrower, and the lower edge 39 of slab 37, which is the ground engaging edge when the foot is in the FIG. 3 position, has a diagonal edge 39 which is oppositely inclined form edge 33. The opposite inclination of edge 39 is due to the fact that the rear legs 5 are oppositely inclined from front legs 3 and so their lower edges, in order to rest flat against a firm supporting surface such as a floor, should have the opposite inclination from edges 33. Apart from these points, and a corresponding narrower construction of, for example, plate 21', strap 27' and piece 29' of the hook and eye fabric, the structures of feet 13 and 35 can be identical.

It will thus be seen that, in the FIG. 3 position of the parts, a simple and reliable, safe and strong construction is provided which rests on a firm supporting surface as surely and reliably as would a front leg 3 of the stepladder 1 without the foot 13. But in the FIG. 4 position, it will be seen that a broad foot provided by the extended slab 15 is provided, whose area is very much greater than that of the lower edge of front leg 3 and so the ladder is reliably supported in soft soil or sand or the like.

Moreover, it will be seen that the ladder cannot swing about any of the hinges 17 as a pivot, when the feet are in their FIG. 4 position, because, as noted above, the members 19 and 31 serve as positive stops, those of one foot on one side of the ladder serving as a positive stop against relative vertical swinging movement of 3 and 15 in one direction, and those on the other side of the ladder associated with the other leg thereof serving as positive stops against relative vertical swinging movement in the other direction about hinge 17, because the feet 13 and 13' on the right and left side of the ladder, respectively, are mirror image of each other. The same of course is true for the rear feet 35 and 35'.

At the same time, it will be noted that the construction provided by the present invention is simple, inexpensive and quite durable, having no parts that would likely wear out and no parts having a tendency to break.

From a consideration of the foregoing disclosure, therefore, it will be evident that all of the initially recited objects of the present invention have been achieved.

Although the present invention has been described in connection with a preferred construction thereof, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A ladder having legs having lower ends, and a safety foot pivotally connected to each said lower end, each safety foot comprising a hinge having two plates one of which is secured to said foot and the other of which is secured to said lower end, one said hinge plate supporting a stop surface that contacts a stop surface supported by the other said hinge plate when said foot is at right angles to said leg, and means releasably retaining said foot in a position substantially parallel to said leg, one of said stop surfaces being provided by a member that is L-shaped to surround said hinge, said L-shaped member being disposed below the lower end of said leg.

2. A ladder as claimed in claim 1, said releasable retaining means comprising hook and eye fabric one element of which is connected to said lower end of said leg and the other element of which is connected to said foot.

3. A ladder as claimed in claim 2, said hinge plate being integral with a member that extends along the lower end of said leg, one element of said hook and eye fabric being fixedly secured at one end between said member and said leg and being free at another end thereof.

4. A ladder as claimed in claim 1, said ladder being a stepladder and a ground engaging edge of said foot being inclined at an acute angle to the axis of said hinge.

5. A ladder as claimed in claim 1, said other hinge plate being integral with a metal plate that is elongated in the direction of the length of said leg and is fixedly secured to said leg.

* * * * *